United States Patent [19]

Logan

[11] Patent Number: 5,020,347

[45] Date of Patent: Jun. 4, 1991

[54] KEY SAFE APPARATUS

[75] Inventor: Karl P. Logan, Charlotte, N.C.

[73] Assignee: One Way Out, Inc., Charlotte, N.C.

[21] Appl. No.: 476,817

[22] Filed: Feb. 7, 1990

[51] Int. Cl.[5] ..... E05B 11/00

[52] U.S. Cl. ..... 70/389; 194/212; 211/9

[58] Field of Search ..... 211/9; 70/388, 389, 70/441, 61; 194/212

[56] References Cited

U.S. PATENT DOCUMENTS

| | | | |
|---|---|---|---|
| 537,311 | 4/1895 | Schade | 70/441 |
| 2,064,474 | 12/1936 | Hopkins | 70/389 |
| 2,220,786 | 11/1940 | Grainger | 70/262 |
| 2,336,936 | 12/1943 | Johnson . | |
| 2,396,759 | 3/1946 | Thieme . | |
| 2,568,206 | 9/1951 | Seaman et al. | 70/388 |
| 3,154,938 | 11/1964 | Cohen . | |
| 4,472,952 | 9/1984 | Hollowell, Jr. | 70/389 X |
| 4,641,509 | 2/1987 | Batchelor et al. | 70/389 X |
| 4,753,092 | 6/1988 | Mercer | 70/389 |

FOREIGN PATENT DOCUMENTS

| | | | |
|---|---|---|---|
| 2213342 | 9/1973 | Fed. Rep. of Germany | 70/389 |

*Primary Examiner*—Lloyd A. Gall

*Attorney, Agent, or Firm*—Shefte, Pinckney & Sawyer

[57] ABSTRACT

An apparatus for alternately retaining a selected one of a pair of keys and releasing the other one of the pair of keys is provided. The retained key cannot be released until the other key is again disposed in a retained position. The apparatus includes a base plate having a pair of key receptacles, a slider member slidably mounted on the base plate, a visitor key having a pinion gear and a home key. The slider member includes a pair of key retaining slots for respectively retaining each key and a rack for driving engagement by the visitor key pinion gear for effecting sliding movement of the slider member in response to rotation of the visitor key pinion gear. A conventional key can be secured to the home key to control use of the conventional key through the selected release and retention of the visitor key and the home key.

3 Claims, 3 Drawing Sheets

Fig 5
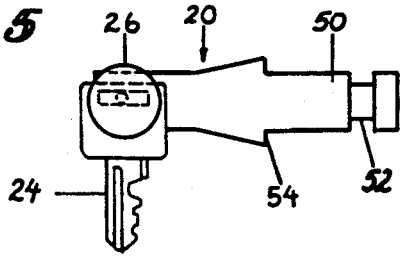
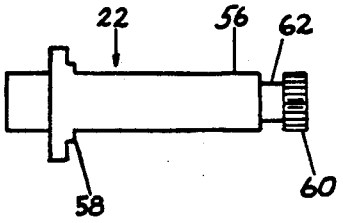
Fig 6
Fig 4
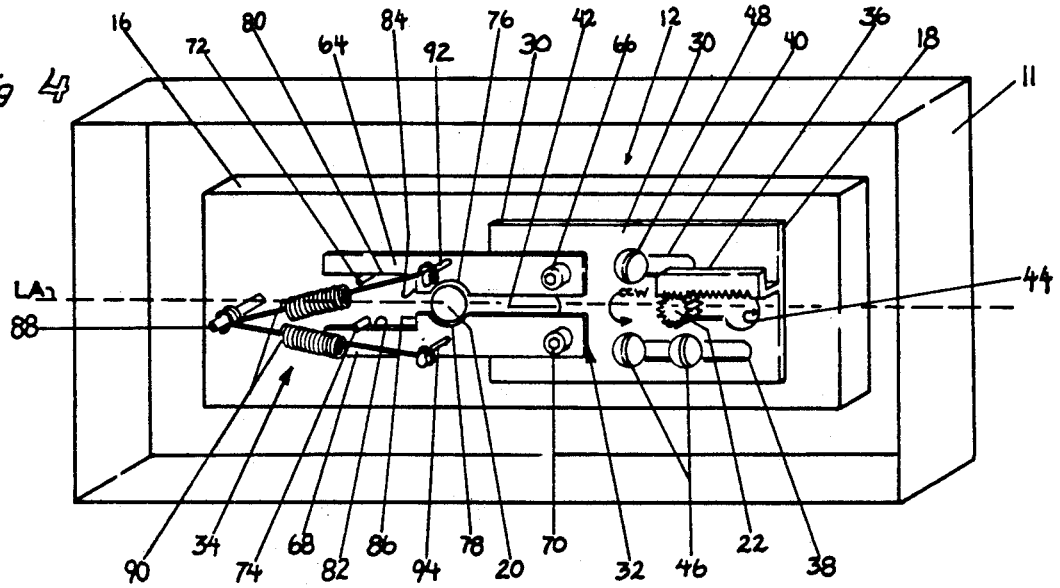
Fig 3
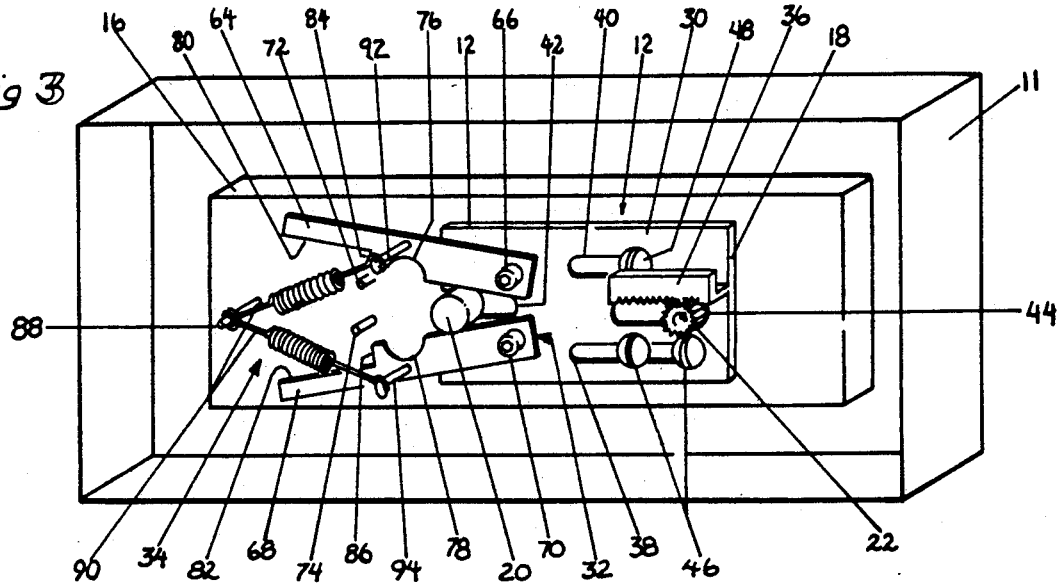

KEY SAFE APPARATUS

BACKGROUND OF THE INVENTION

The present invention relates to a key safe apparatus and, more particularly, to an apparatus for alternately retaining a selected one of a pair of keys upon the release of the other key until the other key is again disposed in a retained diposition.

In organizations having inventory items, such as automobiles or other vehicles, which are each individually accessed and/or operated by a dedicated key, there is an acute need to maintain the keys in an orderly and organized manner, preferably in a central location, so that members of the organization, such as sales people and the like, can reliably and readily locate a key to conduct test drives, offer product demonstrations and conduct other activities with the individually accessible inventory item. In this regard, experience has shown that the approach of merely providing a central keyboard or keybox in which the keys are collectively stored soon undermines the goal of maintaining the keys in a readily retrievable disposition. For example, several of the key users are invariably delinquent in returning the "borrowed" keys to the central keyboard or keybox. Likewise, the key users often find it convenient to borrow several keys at once, thereby depriving others of the opportunity to make use of the borrowed keys unless the multiple key borrower is identified and contacted to obtain the desired keys.

Accordingly, the need exists for an apparatus which insures that a desired key will not be released to a potential key user unless some means of identification, such as the potential key user's own key, is automatically retained in response to the borrowing of the desired key. Additionally, the need exists for an apparatus for selectively releasing and retaining keys which only releases the key user's identification means, such as the user's own keys, upon disposition of the borrowed key in a key retained position.

SUMMARY OF THE INVENTION

The present invention provides an apparatus which insures that a desired key will not be released to a potential key user unless the potential key user's own key is relinquished for the duration of the use of the desired key.

Briefly described, the present invention provides a device for alternately locking a selected one of a pair of keys and releasing the other key for removal from the device. The device includes a home key normally locked in the device, a visitor key normally not locked in the device, lock base means defining a pair of key receptacles and locking means movable relative to the lock base means. Each key receptacle of the lock base means receives a respective one of the home and visitor keys. The locking means is movable between a first position locking the home key in its key receptacle and a second position releasing the home key for removal from its key receptacle. The locking means includes operating means, compatibly configured with the visitor key, for effecting movement of the locking means between its first and second positions in response to movement of the visitor key when received in its key receptacle and for locking the visitor key in its key receptacle in response to movement of the locking means into its second position.

According to the preferred embodiment of the device of the present invention, the home key includes a main body portion having a free insertion end and a portion, spaced from its free end, of reduced cross section, the visitor key includes a main body portion having a free insertion end, a portion, spaced from its free end, of reduced cross section, and a gear portion. Additionally, in the preferred embodiment, the locking means includes a slider member movably mounted to the lock base means for moving transversely to the key receptacles, a toothed rack secured to the slotted member and a slider member limit means.

Preferably, the slider member includes a home key slot having a width less than the cross sectional extent of the main body portion of the home key yet greater than the cross sectional extent of the reduced cross section portion thereof, and a visitor key slot having a narrow portion of a width less than the cross sectional extent of the main body portion of the visitor key yet greater than the cross sectional extent of the reduced cross section portion thereof, the narrow portion of the visitor key being adapted for selectively engaging the visitor key at its reduced cross section portion in a fork-like manner. Also, the slider member includes an enlarged portion having a width greater than the cross sectional extent of the main body portion of the visitor key.

Preferably, the toothed rack is configured for engagement by the gear portion of the visitor key. Also, the slider member limit means preferably includes a pair of pivot arms both pivotably mounted to the slide member, each pivot arm including a shoulder and a travel surface, a pair of stop pins mounted to the lock base means and means for biasing each pivot arm shoulder into engagement with their respective stop pin when the locking means is moved to the second position.

BRIEF DESCRIPTION OF THE DRAWINGS

FIG. 3 is an enlarged rear perspective view of the preferred embodiment of the apparatus shown in FIG. 2, showing the locking means of the apparatus in its first position for locking the home key of the apparatus in its key receptacle;

FIG. 4 is an enlarged rear perspective view of the apparatus shown in FIG. 2, showing the locking means of the apparatus in its second position releasing the home key for removal from its key receptacle and locking the visitor key in its key receptacle;

FIG. 5 is a side elevational view of the home key of the apparatus;

FIG. 6 is a side elevational view of the visitor key of the apparatus; and

DETAILED DESCRIPTION OF THE PREFERRED EMBODIMENT

Figure 1:
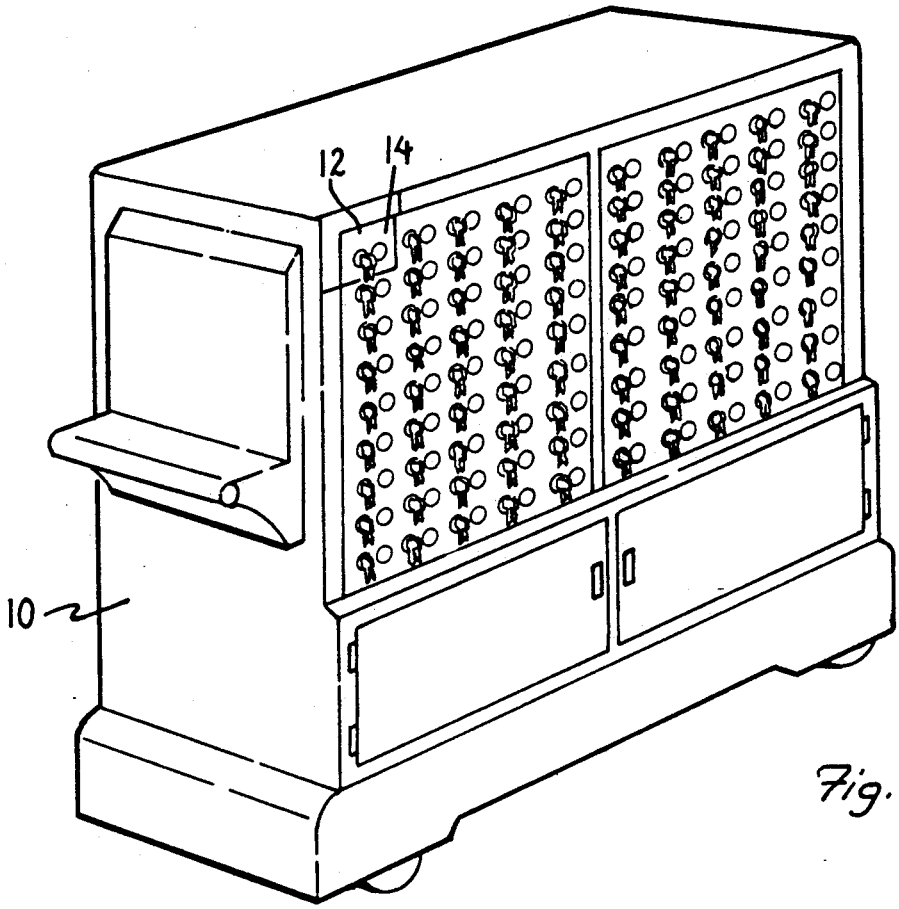
FIG. 1 is a perspective view of a cabinet supporting a plurality of identical units of one preferred embodiment of the key safe apparatus of the present invention.
Figure 2:
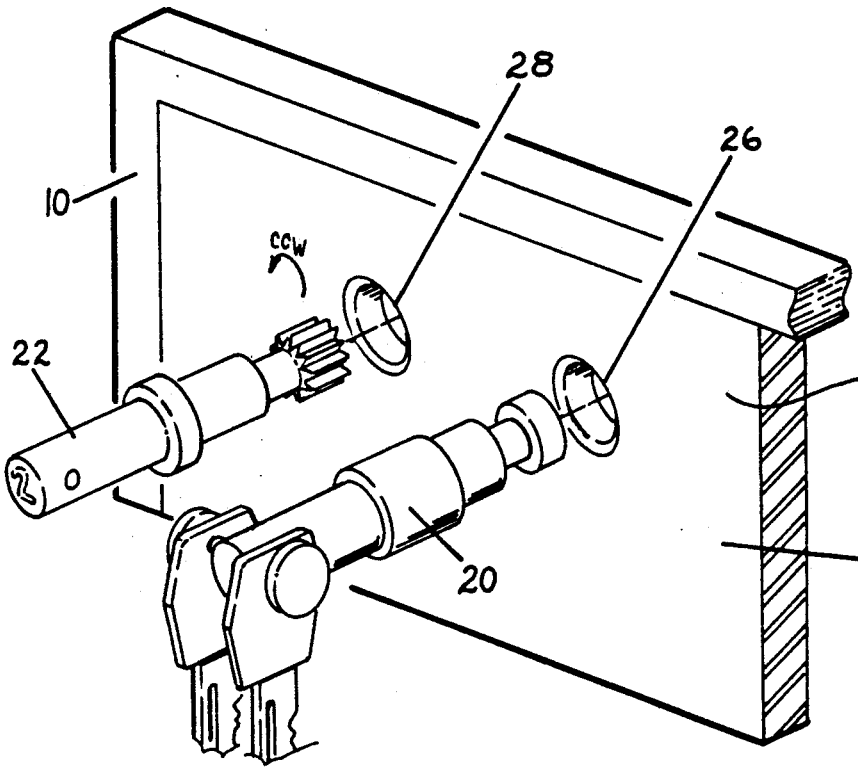
FIG. 2 is an enlarged front perspective view of one unit of the preferred embodiment of the apparatus shown in FIG. 1.

In FIG. 1, a cabinet 10 is illustrated which supports a plurality of identical units of the preferred embodiment of the key safe apparatus of the present invention and a representative unit of the apparatus is generally designated as 12. The identical units of the key safe apparatus 12 are arranged in horizontal rows and vertical columns with one another with the outer faces 14 thereof commonly forming a generally planar cabinet face.

With reference now to FIGS. 2–6, the structure and operation of each unit of the key safe apparatus 12 of the present invention will be described in further detail with respect to the key safe apparatus unit 11 in the upper left-hand corner of the cabinet 10, it being understood that the other key safe apparatus units are similarly configured and operated. The key safe apparatus 12 includes a lock base means, such as a base plate 16, a locking means, such as a slider member 18, a home key 20 and a visitor key 22. The visitor key 22 has a conventional key 24 secured thereto by a conventional key loop 26. In accordance with the present invention, the key safe apparatus 12 provides a means for controlling access to the conventional key 24 through selected release and retention of the home key 20 caused by the interrelated operations of the home key 20 and the visitor key 22. The conventional key 24 can be, for example, a key uniquely configured to lock and unlock an inventory item, such as an automobile. As will be described in more detail, each person desiring to gain access to a particular one of the conventional keys 24 is provided with one copy of the visitor key 22. The key safe apparatus 12 is adapted to alternately lock a selected one of the home key 20 and the visitor key 22 while simultaneously releasing the other key, whereby a person desiring to borrow a particular one of the conventional keys 24 must forfeit possession of his or her visitor key 22 until the home key 20 to which the particular conventional key 24 is secured is again returned to, and retained by, the cabinet 10.

The base plate 16 is a generally rigid, entry-resistant structure, such as, for example, a rectangular metal or high impact plastic plate, which is secured in flush relation to the back of the outer face 14 by welding or other appropriate securement means and the base plate 16 defines a pair of key receptacles 26, 28, the key receptacle 26 being adjusted for receiving the home key 20 and the key receptacle 28 being adapted for receiving the visitor key 22. The key receptacles 26, 28 are cylindrical throughbores extending through the base plate 16 and being laterally aligned with one another on a longitudinal axis LA of the base plate 16. The outer face 14 is provided with a pair of compatibly aligned throughbores, each such throughbore being aligned with a respective one of the key receptacles 26, 28 for permitting access of the home key 20 and the visitor key 22 through the outer face 14 into their respective key receptacles 26, 28.

The slider member 18 includes a generally rectangular metal or high impact plastic plate 30, a slider member limit means 32, a biasing means 34 and a toothed rack 36. The plate 30 includes a first mounting slot 38 extending longitudinally of the plate, a second mounting slot 40 spaced laterally of the first mounting slot 38 and extending generally parallel thereto, a home key retaining slot 42 and a visitor key retaining slot 44. The plate 30 is slidably mounted to the base plate 16 by a pair of first mounting bolts 46 inserted through the first mounting slot 38 and threaded into respective cooperatively located threaded bores in the base plate 16 and by a second mounting bolt 48 inserted through the second mounting slot 40 and threaded into a cooperatively located threaded bore in the base plate 16. As can be understood, the plate 30 is constrained by the first mounting bolts 46 and the second mounting bolts 48 to slide in a longitudinal direction with respect to the base plate 16—i.e., in substantial alignment with the longitudinal axis LA.

As best seen in FIG. 3 and 4, the home key retaining slot 42 is an openend rectangular slot extending longitudinally of the plate 30. The home key retaining slot 42 is located such that the home key 20 is received therein throughout the longitudinal sliding movement of the plate 30 relative to the base plate 16 when the key is inserted in its key receptacle 26. The visitor key retaining slot 44 includes a portion extending longitudinally of the plate 30 of generally uniform lateral extent transversely to its longitudinal extent and a cylindrical portion. The longitudinal portion extends from its one closed end in a direction away from the home key retaining slot 42 toward its other end, which is open and communicated with the cylindrical portion. The cylindrical portion has a diameter greater than the lateral extent of the longitudinal portion. The visitor key retaining slot 44 is located such that the visitor key 22 is received therein during the entire travel of the plate 30 with respect to the base plate 16 when the visitor key 22 is inserted into its key receptacle 28.

With reference to FIG. 5, the home key 20 includes a cylindrical portion 50 having an annular groove 52 formed therein adjacent the free end of the key and an annular shoulder 54 formed at the end of the cylindrical portion opposite its free end. The annular groove 52 has a diameter slightly less than the lateral extent of the home key retaining slot 42 transversely to the longitudinal extent thereof and the cylindrical portion 50 is of a diameter greater than the lateral extent of the home key retaining slot 42.

The spacing of the annular shoulder 54 from the annular groove 52 is selected such that the annular groove 52 is in alignment with the plate 30 when the home key 20 is sufficiently inserted into its key receptacle 26 to bring the annular shoulder 54 into abutment with the front face 14 of the cabinet 10. As can be understood, the plate 30 engages the home key 20 in a fork-like manner when the plate is moved such that the annular groove 52 is received in the home key retaining slot 42.

As seen in FIGS. 3 and 4, the toothed rack 36 is in the form of a conventional linear tooth rack of a rack and pinion gear type assembly and is rigidly fixed by welding or other appropriate securement means to the plate 30 with the teeth thereof extending longitudinally of the plate 30 and cooperatively located in parallel adjacent relation to the visitor key retaining slot 44. Specifically, the teeth of the toothed rack 36 are positioned for engagement by the visitor key 22 when the visitor key is inserted into its key receptacle 28. In this regard, the visitor key 22 includes a cylindrical portion 56 having an annular shoulder 58 formed at one end thereof and a pinion gear 60 formed at the other end thereof, as seen in FIG. 6. The pinion gear 60 is spaced from the annular shoulder 58 such that the pinion gear 60 extends slightly beyond the plate 30 for meshing engagement with the rack 36 when the visitor key 22 is inserted in its key receptacle 28 with the annular shoulder 58 in abutment with the outer face 14 of the key safe apparatus 12.

An annular groove 62 is formed inwardly of, and adjacent to, the pinion gear 60 and is of a diameter slightly less than the lateral extent of the longitudinal portion of the visitor key retaining slot 44. The outer diameter of the pinion gear 60 and the diameter of the cylindrical portion 56 of the visitor key 22 are each of a diameter slightly greater than the lateral extent of the longitudinal portion of the home key retaining slot 44 but less than the diameter of the cylindrical portion of the slot.

As can thus be understood, the pinion gear 60 is adapted to engage the toothed rack 36 in well known rack and pinion manner to effect sliding movement of the plate 30 relative to the base plate 16 upon rotation of the visitor key 22. Accordingly, the toothed rack 36 is positioned on the plate 30 such that the teeth of the pinion gear 60 engage the teeth of the toothed rack 36 when the visitor key 22 is inserted in its key receptacle 28 so that rack and pinion-type movement can be effected by rotation of the visitor key 22.

The slider member limit means 32 includes an upper pivot arm 64 pivotally mounted to the plate 30 by a pivot 66, a lower pivot arm 68 pivotally mounted to the plate 30 by a pivot 70, an upper stop pin 72 and a lower stop pin 74. The upper pivotal arm 64 and the lower pivot arm 68 are each formed with a semi-cylindrical recess 76, 78, respectively, a linear travel surface 80, 82, respectively, and a shoulder 84, 86, respectively. The pivot arms 64, 68 are urged to pivot oppositely about their respective pivots 66, 70 toward one another by the biasing means 34. The biasing means 34 includes a post 88 projecting from the base plate 16 and located on the longitudinal axis LA, a pair of springs 90, a spring attachment post 92 projecting from the upper pivot arm 64 and a spring attachment post 94 projecting from the lower pivot arm 68. Each spring 90 is secured at one end to the post 88 and at its other end to a respective one of the spring attachment posts 92, 94. Since the post 88 is aligned with the key receptacles 26, 28 on the longitudinal axis LA and the spring attachment posts 92, 94 are laterally offset from the longitudinal axis LA in respective opposite directions, the springs 90 bias the upper pivot arm 64 to pivot counterclockwise (as viewed in FIGS. 3 and 4) about its pivot 66 and the pivot arm 68 to pivot clockwise (as viewed in FIGS. 3 and 4) about its pivot 70. The stop pins 72, 74 are each respectively laterally offset from the longitudinal axis LA at positions for engaging the respective travel surfaces 80, 82 of the upper and lower pivot arms 64, 68 for limiting the respective pivoting of the associated upper pivot arm 64 and lower pivot arm 68 toward one another caused by the urging of the biasing means 34.

As shown in FIG. 4, when the travel surface 80 of the upper pivot arm 64 is biased against the stop pin 72 by the biasing means 34, the upper pivot arm 64 extends generally longitudinally with its semi-cylindrical recess 76 opening downwardly. Similarly, with the travel surface 82 of the lower pivot arm 68 biased in contact with the stop pin 74 by the biasing means 34, the lower pivot arm 68 extends generally longitudinally with its semi-cylindrical recess 78 facing upwardly.

The operation of the key safe apparatus 12 will now be described with respect to FIGS. 3 and 4. As shown in FIG. 3, the home key 20 is normally inserted in its key receptacle 26 and the slider member 18 is disposed in a first position locking the home key 20 in its key receptacle 26. Specifically, the plate 30 of the slider member 18 is disposed at its leftmost position (as viewed in FIG. 3) with respect to the base plate 16 with the rightwardmost mounting bolt 46 and the mounting bolt 48 preventing further leftward travel of the slider member 18. In this disposition of the slider member 18, the cylindrical portion of the visitor key retaining slot 44 is generally aligned with the visitor key receptacle 28 and the home key retaining slot 42 receives the annular groove 52 of the home key 20 whereby the plate 30 engages the annular groove 52 of the home key 20 in a fork-like manner to prevent release of the key from the key safe apparatus 12. In the first position of the slider member 18, the upper pivot arm 64 is in contact with the home key 20, which urges the upper pivot arm 64 away from the stop pin 72 against the urging of the biasing means 34. Similarly, in the first position of the slider member 18, the lower pivot arm 68 is in contact with the home key 20, which urges the lower pivot arm 68 away from the stop pin 74 against the urging of the biasing means 34. As can thus be understood, the home key 20 cannot be removed from the cabinet 10 since the plate 30 prevents axial movement of the home key 20. Each of the home keys 20 illustrated in FIG. 1 are normally locked in the cabinet 10 in this manner by the key safe apparatus 12.

If a person desires to remove a selected one of the home keys 20 for use of its particular conventional key 24 secured thereto, the person must possess one copy of the visitor key 22, which are all of identical configuration. The person need only then insert his or her visitor key 22 into the visitor key receptacle 28 of the pair of key receptacles 26, 28 associated with the selected home key 20. As seen in FIG. 3, since the cylindrical portion of the visitor key retaining slot 44 is aligned with the visitor key receptacle 28 when the slider member 18 is in its first position in which it locks the home key 20, the visitor key 22 can be fully inserted into the key receptacle 28 until its annular shoulder 58 abuts the outer face 14. The complete insertion of the visitor key 22 into its key receptacle 28 also brings the pinion gear 60 thereon into meshing engagement with the toothed rack 36 on the plate 30. Accordingly, when the visitor key 22 is thereafter rotated about its axis, the pinion gear 60, via its driving engagement with the toothed rack 36, moves the plate 30 longitudinally relative to the base plate 16 in the right-hand direction as viewed in FIG. 3.

When the visitor key 22 is rotated in a counterclockwise direction CCW (as viewed in FIG. 2; i.e. clockwise as viewed in FIGS. 3 and 4), the plate 30 is moved longitudinally (from left to right as viewed in FIGS. 3 and 4) from its first position in which it locks the home key 20 to a second position releasing the home key 20 for removal from its key receptacle 26 and locking the visitor key 22 in its key receptacle 28, as shown in FIG. 4. Specifically, the plate 30 moves to the right (as viewed in FIG. 4) relative to the base plate 16 and, during this movement, the visitor key retaining slot 44 moves relative to the visitor key 22 and the upper pivot arm 64 and the lower pivot arm 68 are urged by the biasing means 34 to pivot oppositely toward one another. As the visitor key retaining slot 44 moves relative to the visitor key 22, the rectangular portion of the slot engages the annular groove 62 of the visitor key, to lock the visitor key with respect to the base plate 16. That is, the interengagement of the plate 30 and the annular groove 62 of the visitor key 22 prevent axial movement—i.e., withdrawal—of the visitor key 22. Thus, the visitor key 22 cannot be removed from its key receptacle 28 when the slider member 18 is disposed in its second position. The rightward movement of the plate 30 relative to the base plate 16 also causes the upper pivot arm 64 and the lower pivot arm 68 to travel tangentially across the home key 20.

The pivotal mounting dispositions of the upper pivot arm 64 and the lower pivot arm 68 on the plate 30 is such that the biasing means 34 pivots the arms 64, 68 during rightward sliding movement of the plate 30 to move their travel surfaces 80, 82 into engagement respectively with the stop pins 72, 74 and their respective semi-cylindrical portions 76, 78 into alignment with the home key 20 immediately after the left-hand end of the plate 30 has cleared the annular groove 52 of the home key 20. Since the semi-cylindrical portions 76, 78 generally define a cylindrical opening therebetween of a larger diameter than the home key 20, the home key 20 is thus released for removal from its key receptacle 26 and can be withdrawn by the key borrower for use of the conventional key 24 secured thereto.

To insure that the key borrower returns the home key 20 to its key receptacle 26, the key safe apparatus 12 is configured to retain the visitor key 22 in its locked disposition in its key receptacle 28 when the home key 20 is released from its locked position in its key receptacle 26. Specifically, as seen in FIG. 4, attempted counterclockwise rotation (in the direction CCW shown in FIGS. 3 and 4) of the visitor key 22 produces, via the toothed rack 36, only very limited movement of the plate 30 in a leftward direction with respect to the base plate 16. The limitation on the leftward movement of the plate 30 is accomplished by the plate movement limit means 32 as follows. With the semi-cylindrical recess 76 of the upper pivot arm 64 aligned with the home key receptacle 26, the biasing means 34 continuously urges the travel surface 80 of the upper pivot arm 64 downwardly into contact with the stop pin 72. Likewise, the biasing means 34 continuously urges the travel surface 82 of the lower pivot arm 68 into contact with the stop pin 74 when the semi-cylindrical portion 76 of the lower pivot arm 68 is aligned with the home key receptacle 26. Accordingly, during any attempted leftward movement of the plate 30 via driving rotation of the pinion gear 60 along the toothed rack 36, the biasing means 34 continuously maintains the upper pivot arm 64 in contact with the stop pin 72 and the lower pivot arm 68 in contact with the stop pin 74. Accordingly, any leftward movement of the plate 30 immediately brings the shoulder 84 of the upper pivot arm 64 into abutment with the stop pin 72 and, at substantially the same time, brings the shoulder 86 of the lower pivot arm 68 into abutment with the stop pin 74. The abutting contact between the shoulders 84, 86 and their respective stop pins 72, 74 prevents further leftward movement of the plate 30 relative to the base plate 16.

The shoulders 84, 86 are spaced from the respective pivots 66, 70 of the pivot arms such that they move into abutment with the stop pins 72, 74 before the plate 30 can travel sufficiently for the plate to move out of engagement with the annular groove 62 of the visitor key 22. Accordingly, when the home key 20 has been removed from its key receptacle 26, the rotation of the visitor key 22 alone is not effective to release the plate 30 from its locking engagement with the annular groove 62 of the visitor key and the key cannot be withdrawn from the cabinet 10. Thus, the key safe apparatus 12 of the present invention insures that the key borrower's copy of the visitor key 22 is always "relinquished" to permit release of the desired home key 20. If desired, each copy of the visitor key 22 can be tagged or otherwise provided with an identification means so that the identity of the particular copy disposed in a given key receptacle 28 can be noted to determine the identification of the key borrower.

Once the key borrower has completed his or her use of the conventional key 24 of the borrowed home key 20, the home key 20 is reinserted into its key receptacle 26. If the plate 30 has, in the meantime, been moved relative to the base plate 16 since the release of the home key 20 such that the semi-cylindrical portions 76, 78 of the pivot arms are no longer in exact alignment with the visitor key receptacle 26, the key borrower need only rotate the visitor key 22 until the semi-cylindrical portions 76, 78 are again brought into alignment with the home key receptacle 26, thereby permitting the home key 20 to be fully inserted into its key receptacle. To then secure release of his or her copy of the visitor key 22, the key borrower need only rotate the visitor key 22 in a clockwise direction to move the slider member 18 between its second position shown in FIG. 4 to its first position shown in FIG. 3. During the movement of the slider member 18 between its second and first positions, the inserted home key 20 serves as a wedge or cam means between the upper pivot arm 64 and the lower pivot arm 68 to urge the upper pivot arm 64 and the lower pivot arm 68 to pivot in opposite directions away from one another against the urging of the biasing means 34. Simultaneously with the opposite pivoting of the pivot arms, the left-hand movement of the plate 30 brings the plate into locking interengagement with the annular groove 52 of the home key 20 as the annular groove 52 is received in the home key retaining slot 42.

In its role as a wedge means, the inserted home key 20 sufficiently pivots the upper pivot arm 64 in a clockwise direction and the lower pivot arm 68 in a counterclockwise direction for the pivot arms to clear the stop pins 72, 74 as the plate 30 continues its leftward movement relative to the base plate 16. Thus, the continued clockwise rotation of the visitor key 22 eventually moves the plate 30 to the left sufficiently for the slider member 18 to reach its first position in which the cylindrical portion of the visitor key retaining slot 44 moves into alignment with the visitor key 22, thus releasing the visitor key 22 for removal from its key receptacle 28.

The key safe apparatus 12 of the present invention thus advantageously provides an apparatus for alternately locking a selected one of a pair of keys and releasing the other key for removal from the apparatus. Accountability for borrowed keys can be maintained since a key borrower must relinquish possession of his or her copy of the visitor key to effect removal of the home key. Likewise, the key borrower cannot regain possession of his or her copy of the visitor key until the borrowed home key has been returned to, and locked in, the key safe apparatus.

Figure 7:
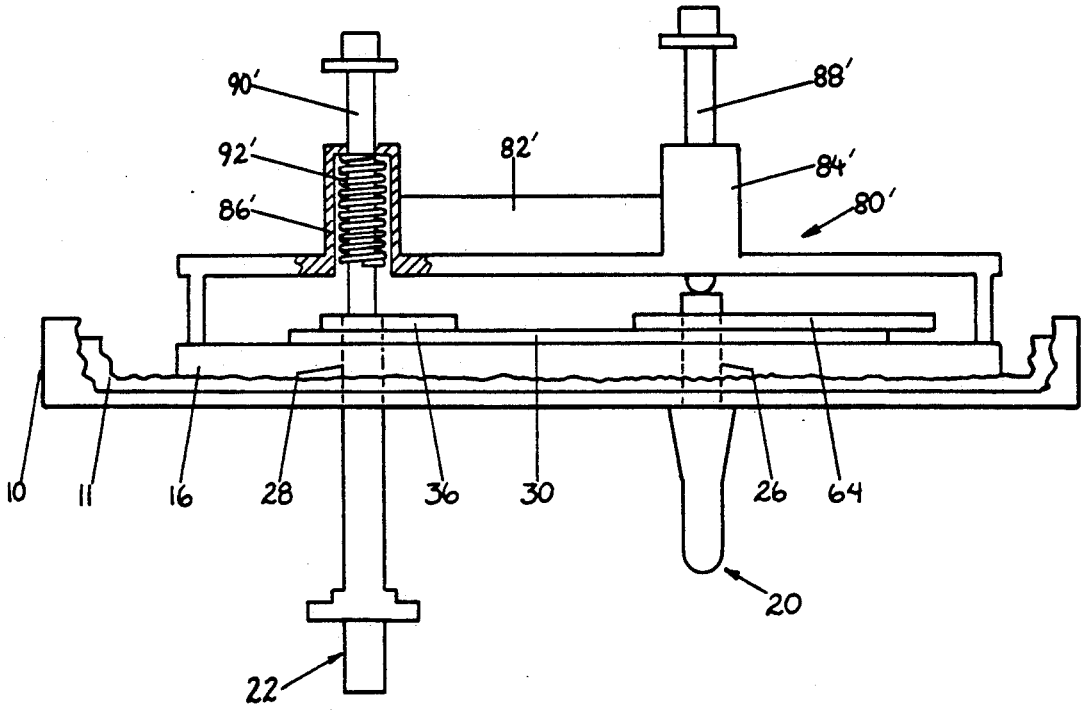
FIG. 7 is a top plan view, in partial section, of the unit shown in FIG. 2, taken along lines VII—VII.

In FIG. 7, a key plunger assembly 80' is illustrated for urging the home key 20 and the visitor key 22 out of their respective receptacles 26, 28. The key plunger assembly 80' includes a body portion 82' fixedly secured to the base plate 16 at a rearward spacing therefrom and having a pair of spaced, cylindrical bores 84', 86'. Each cylindrical bore 84', 86' movably retains therein a key plunger 88, 90', respectively, and each key plunger 88, 90' is urged toward one axial direction in its respective cylindrical bore 84', 86' by a spring 92' (only one of which is shown) disposed intermediate the plunger 88, 90' and its associated cylindrical bore.

The key plungers 88, 90' are adapted to urge the home key 20 and the visitor key 22, respectively, out of the respective key receptacles 26, 28. To this end, the cylindrical bores 84', 86' are aligned with the key receptacles 26, 28, respectively, and the key plungers 88, 90' are formed of a rigid material for non-deformably contacting the free ends of the home key 20 and the visitor key 22 to urge the keys out of their key receptacles. The springs 92' are selected with appropriate spring characteristics sufficient to cause outward axial movement of the free end of each key 20, 22 along the key receptacles 26, 28 yet insufficient to completely eject the keys. Thus, when the home key 20 is released upon movement of the slider member 18 into the second position (FIG. 4), the plunger 88 assists the borrower in withdrawing the home key and, likewise, removal of the visitor key 22 is assisted by the plunger 90' when the slider member 18 is thereafter returned to the first position (FIG. 3).

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for alternately locking a selected one of a pair of keys and releasing the other key for removal from the device, the device comprising:

a home key normally locked in the device, the home key including a main body portion having a free insertion end and a portion, spaced from its free end, of reduced cross-section;

a visitor key normally not locked in the device, the visitor key including a main body portion having a free insertion end, a portion, spaced from its free end, of reduced cross-section, and a gear portion;

lock base means defining a pair of key receptacles, one key receptacle for receiving the home key and the other key receptacle for receiving the visitor key; and locking means movable relative to the lock base means between a first position locking the home key in its key receptacle and a second position releasing the home key for removal from its key receptacle, the locking means including:

a slider member movably mounted to the lock base means for moving transversely to the key receptacle, the slider member including a home key slot having a width less than the cross-sectional extend of the main body portion of the home key yet greater than the cross-sectional extent of the reduced cross-section portion thereof, a visitor key slot having a narrow portion of a width less than the cross-sectional extent of the main body portion of the visitor key yet greater than the cross-sectional extent of the reduced cross-section portion thereof, the narrow portion of the visitor key slot being adapted for selectively engaging the visitor key at its reduced cross-section portion in a fork-like manner, and an enlarged portion having a width greater than the cross-sectional extend of the main body portion of the visitor key, a toothed rack secured to the slider member and being configured for engagement by the gear portion of the visitor key when the visitor key is received in its key receptacle for actuating movement of the slider member relative to the lock base means, the toothed rack being located relative to the visitor key slot such that the visitor key extends through the enlarged portion of the slider member when the locking means is in its first position locking the home key in its key receptacle and such that the narrow portion of the visitor key slot engages the reduced cross-sectional portion of the visitor key as the rotation of the gear portion of the visitor key along the toothed rack moves the slider member relative to the lock base means, the home key slot being located to release the home key therefrom as the slider member is moved relative to the lock base means to dispose the locking means in the second position, and a slider member limit means cooperating with the home key to move between a non-stopping position when the locking means is in its first position and a stopping position when the locking means is in its second position for preventing movement of the slider member to a position in which the visitor key is released therefrom.

2. A device according to claim 1 and characterized further in that the slider member limit means includes a pair of pivot arms both pivotally mounted to the slider member, each pivot arm including a shoulder and a travel surface, a pair of stop pins mounted to the lock base means, means for biasing each pivot arm shoulder adjacent to a respective stop pin when the locking means is moved to the second position.

3. A device according to claim 1 and characterized further in that the main body portion of the home key and the main body portion of the visitor key are cylindrical and the key receptacles are cylindrically shaped for receipt therein of the cylindrical portions of the home key and visitor key.

* * * * *

UNITED STATES PATENT AND TRADEMARK OFFICE

CERTIFICATE OF CORRECTION

PATENT NO. : 5,020,347

DATED : June 4, 1991

INVENTOR(S) : Karl P. Logan

It is certified that error appears in the above-identified patent and that said Letters Patent is hereby corrected as shown below:

Column 4, Line 5, reads "openend" but should read -- open-end --.

Column 10, Line 3, reads "extend" but should read -- extent --.

Column 10, Line 15, reads "extend" but should read -- extent --.

Signed and Sealed this

Twenty-second Day of December, 1992

*Attest:*

DOUGLAS B. COMER

*Attesting Officer*

*Acting Commissioner of Patents and Trademarks*